US005560043A

United States Patent [19]

Armstrong

[11] Patent Number: 5,560,043

[45] Date of Patent: Oct. 1, 1996

[54] WINTER SURVIVAL SUIT WITH EXTENDABLE LEG BAG

[76] Inventor: James R. Armstrong, Box 2115, Virden, Manitoba, Canada, R0M 2C0

[21] Appl. No.: 421,934

[22] Filed: Apr. 14, 1995

[51] Int. Cl.[6] ..... A41D 15/04

[52] U.S. Cl. ..... 2/69.5; 2/85; 2/79

[58] Field of Search ..... 2/69, 69.5, 79, 2/80, 84, 85, 86, 93, 108, 94, 95, 88, 89, 202, 272

[56] References Cited

U.S. PATENT DOCUMENTS

| | | | |
|---|---|---|---|
| 1,485,392 | 3/1924 | Halek | 2/272 |
| 4,103,377 | 8/1978 | Mayer et al. | 2/69.5 |
| 4,158,892 | 6/1979 | Gonzales | 2/69.5 |
| 4,532,654 | 8/1985 | Sigismonde | 2/69.5 |
| 4,575,876 | 3/1986 | Weaver | 2/69.5 |
| 4,995,115 | 2/1991 | Ellis | 2/69.5 |
| 4,998,296 | 3/1991 | Stames | 2/69.5 |
| 5,226,193 | 7/1993 | Chen | 2/69.5 |

*Primary Examiner*—C. D. Crowder
*Assistant Examiner*—Gloria Hale
*Attorney, Agent, or Firm*—Adrian D. Battison; Murray E. Thrift

[57] ABSTRACT

A winter survival suit includes a main suit body for surrounding the body of the wearer from a collar extending downwardly to a bottom edge of the suit body arranged at knee-height or just above on the wearer. A leg bag can be attached to the bottom edge of the suit body by a surrounding zipper. The leg bag can be folded upwardly inside the suit body to be attached by buckles at the bottom end of the leg bag which attach to buckles sewn into the arm seams of the suit body. Alternatively the leg can be folded outwardly of the suit body and attached to similar buckles on the outside of the suit body at the arm openings. The suit body includes a first inner hood which is insulated and can be pulled into a snorkel type opening for cold weather breathing. A second outer hood is attached around the collar and is of larger size for covering the head and face of the wearer in a survival situation or for receiving the whole of the structure of the suit in a packaged situation for transportation.

4 Claims, 3 Drawing Sheets

WINTER SURVIVAL SUIT WITH EXTENDABLE LEG BAG

This invention relates to a winter survival suit for wearing by a person in cold weather conditions in which a suit can be converted from a parka style coat to a body suit.

SUMMARY OF THE INVENTION

It is one object of the present invention to provide an improved article of clothing which can be conveniently worn as a simple parka style coat by a wearer but which can be converted to form a body suit for warmth when the wearer is stationary or for survival conditions.

According to one aspect of the invention there is provided a winter survival suit for a wearer comprising a suit body having an upper collar opening for surrounding the neck of the wearer and extending downwardly from the collar to a generally horizontal open bottom edge for surrounding the legs of the wearer, two arm openings in the suit body each on a respective side of the suit body below the collar, a pair of suit arms sewn into the arm openings at seams each surrounding a respective one of the arm openings, a first hood attached to the collar, so as to be engageable over the head of the wearer, the suit body, suit arms and first hood being lined with an insulating material, a front opening extending from the collar to the bottom edge which is closable by a manually operable closure member, a leg bag having an open upper end and a closed bosom end for surrounding the feet and part of the legs of the wearer and means for attaching the leg bag to the bottom edge so as to form a closure at the bottom of the body suit, wherein the leg bag has first hanger means at a bottom end thereof and the body suit has cooperating second hanger means adjacent the arm openings such that the first and second hanger means cooperate for holding the leg bag up into the body suit to be carried thereby in an area from the arm openings to the bottom edge and behind the wearer.

According to a second aspect of the invention there is provided a winter survival suit for a wearer comprising a suit body having an upper collar opening for surrounding the neck of the wearer and extending downwardly from the collar to a generally horizontal open bottom edge for surrounding the legs of the wearer, two arm openings in the suit body each on a respective side of the suit body below the collar, a pair of suit arms sewn into the arm openings at seams each surrounding a respective one of the arm openings, a first hood attached to the collar so as to be engageable over the head of the wearer, the suit body, suit arms and first hood being lined with an insulating material, a front opening extending from the collar to the bottom edge which is closable by a manually operable closure member, a leg bag having an open upper end and a closed bottom end for surrounding the feet and part of the legs of the wearer and means for attaching the leg bag to the bottom edge so as to form a closure at the bottom of the body suit, including a second hood attached to the collar surrounding the first hood.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
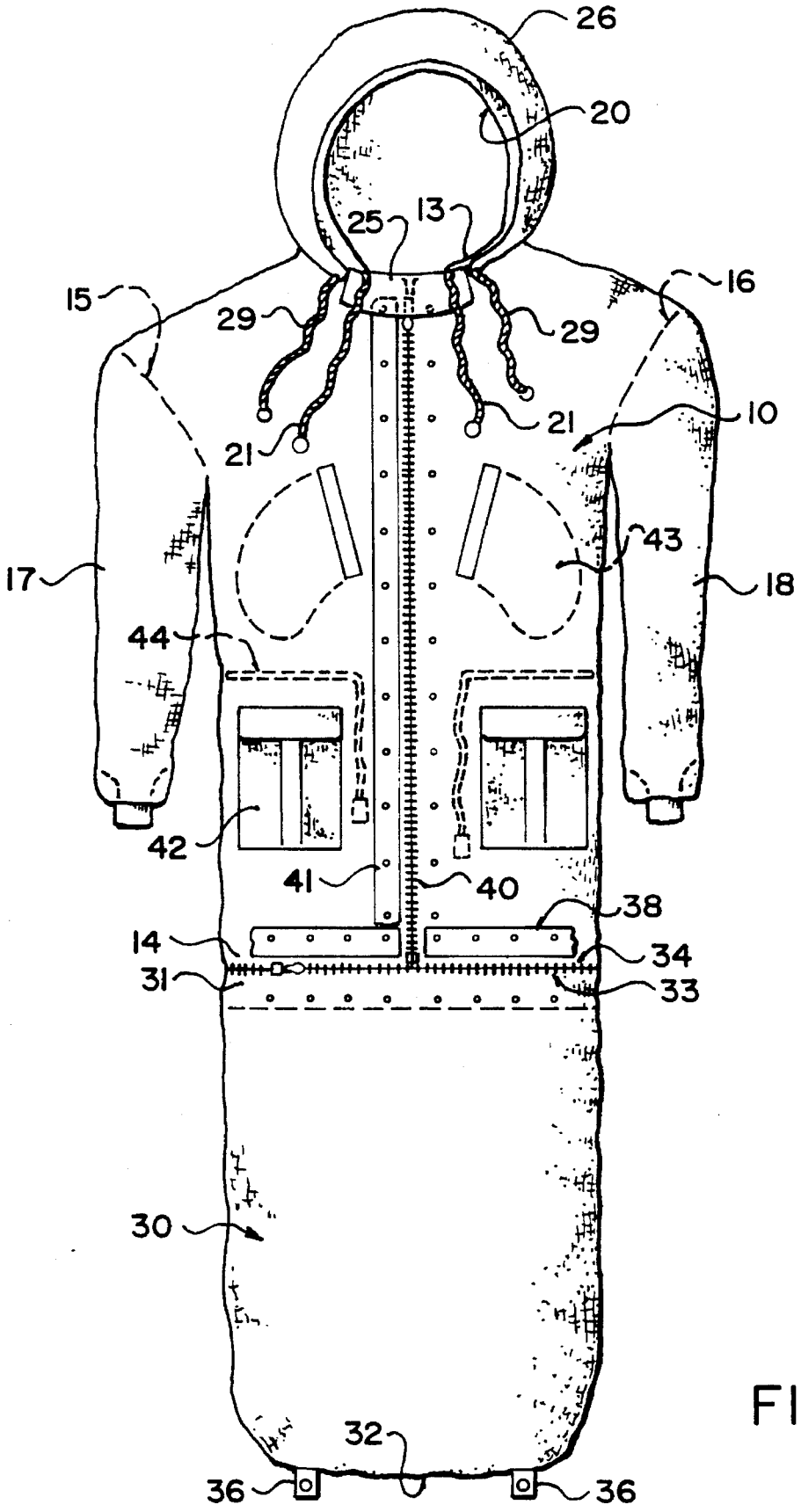
FIG. 1 is a front elevational view of the winter survival suit according to the present invention with the leg bag in place.

The winter survival suit of the present invention comprises a suit body 10 having a front 11 and a rear 12 for surrounding the person of the wearer. The suit body includes a collar at the upper end which is shaped and arranged to engage around the neck of the wearer with a suit body draped over the shoulders of the wearer and extending to a bottom edge 14 of the suit body at a height to engage around the legs of the wearer. The suit body has on its sides a pair of openings 15 and 16 through which the arms of the wearer can pass. A pair of suit arms 17 and 18 are attached onto the sides of the suit body at seams 19 surrounding the openings 15 and 16.

An inner hood 20 is attached around the collar 13 for engaging over the head and around the sides of the face of the wearer. The hood includes at a front opening a drawstring 21 which allows the opening to be pulled inwardly to define a snorkel type opening closed around the face of the wearer and allowing air to enter to the face and mouth of the wearer only through the tubular snorkel type opening thus keeping the air relatively warm and preventing dramatic chilling of the face or lungs of the wearer.

The front of the suit body includes a longitudinal opening which can be closed by a zipper 40 extending from the bottom edge to the collar underneath the throat cover 25 and the zipper is covered by a storm flap 41. On the front outside of the suit body is provided a pair of front pockets 42. Inside pockets 43 are located in the upper part of the chest of the suit body. A center drawstring 44 is provided at the waist of the suit body for drawing the suit body into the waist for further insulation effect when required, The arms, suit body and hood 20 are all formed from an outer layer 22 of a suitable air and moisture resistant fabric such as micro-coated nylon. These elements further include an inner lining fabric 23 and an intervening insulation layer 24 such as bonded polyester. These materials are available for the manufacture of cold weather clothing and provide a high level of resistance to the penetration of the cold air and a high insulation level to cover the full body including the arms and head of the wearer, The coat further includes a throat cover 25 which is attached to one side of the collar and can be stretched across the throat area of the wearer and engage with an opposed side of the collar to assist in closing the hood around the face of the wearer.

Also attached to the collar 13 is an additional or second hood 26 which is formed simply from a fabric shell without an inner liner or insulation material. The second hood is stitched to the seam at the collar and includes a zip fastener 27 which allows the second hood to be removed from a seam portion 28 attached to the seam. The outer hood is of larger size than the hood 20 so that it has a width W which is the majority of the width of the suit body across the area of the shoulders just below the collar 13. The outer hood thus can operate in two functions. Firstly the outer hood can receive the remainder of the suit body including the arms and the hood for storage in a rolled condition inside the outer hood.

Secondly the outer hood has sufficient size that it can engage fully over the head and face of the wearer and over the front opening of the inner hood as indicated at 20A. The outer hood further includes a drawstring 29 which can be pulled to tighten the front edge of the outer hood downwardly to the front of the collar to fully cover the opening 20A of the hood 20.

Figure 3:
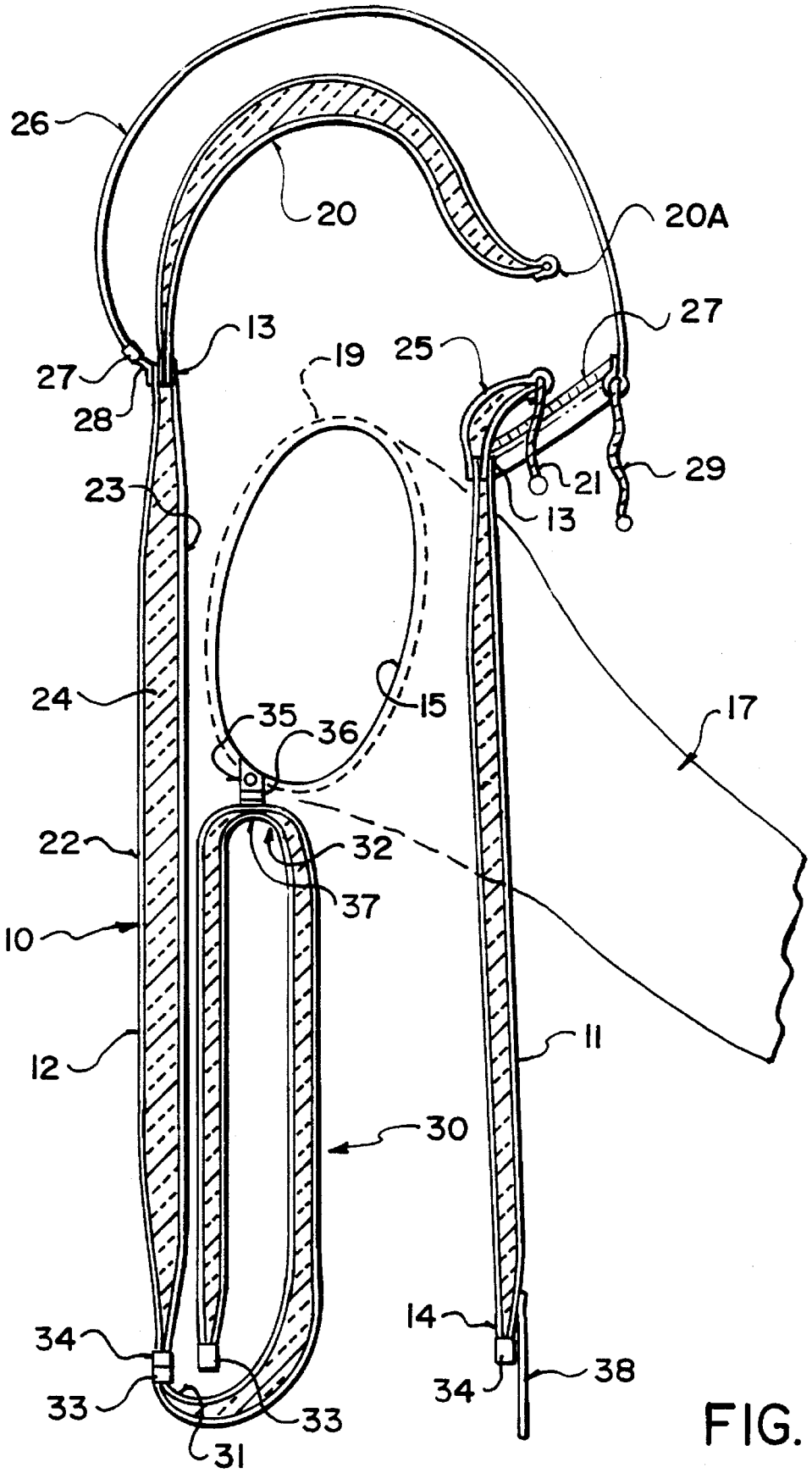
FIG. 3 is a vertical cross sectional view through the winter survival suit of FIG. 1 with the leg bag folded up inside the suit body.

The survival suit further includes a leg bag generally indicated at 30. The leg bag comprises a generally tubular bag with an open upper end 31 and a closed lower end 32 so that it can receive the feet and lower legs of the wearer. The leg bag is again formed from the same outer fabric 22, the same liner 23 and the same interlining 24 which provide the air permeability resistance and the high insulation value of the remainder of the suit. The leg bag includes a zipper 33 attached around the open upper end 31 around the full periphery thereof. The zipper cooperates with a cooperating part 34 of zipper attached to the bottom end 14 of the suit body. Thus the leg bag can be attached using the zipper to the bottom end of the body suit with that zipper being adjusted so as to attach the leg bag only across the rear or around the full periphery as required. As shown in FIG. 3, the leg bag is attached to the suit body across a rear part of the suit body so that it maintained attached to the suit body but the opening at the bottom end 14 of the suit body is available for the legs of the wearer to be exposed through the bottom opening allowing the wearer to stand and walk in conventional manner. In this case the leg bag is folded up inside the suit body and lies against the rear of the suit body between the bottom edge 14 and the bottom of the openings 15 and 16. To maintain the leg bag in supported position within the suit body, a first buckle part 35 is stitched into the seam 19 at each of the arm openings and a second buckle part 36 is attached to the leg bag at the bottom end thereof at a seam 37 closing the closed lower end of the bag. The buckle parts thus cooperate and hold the leg bag normally in the folded position within the suit body. However when it is required to deploy the leg bag, the buckles 35, 36 are released and the leg bag is folded downwardly so that it hangs or depends downwardly from the rear of the suit body. The zipper 33, 34 is then closed around the full periphery of the leg bag thus attaching the leg bag directly to the bottom of the suit body to form a complete bag which can be closed around the whole of the person of the wearer as a "mummy" bag or survival suit. A storm flap 38 is provided across the front of the suit body at the bottom for covering the zipper 33, 34 with the storm flap being attached to the suit body at its upper part and fastenable by snap fasteners to the leg bag below the line of the zipper 33, 34.

Figure 2:
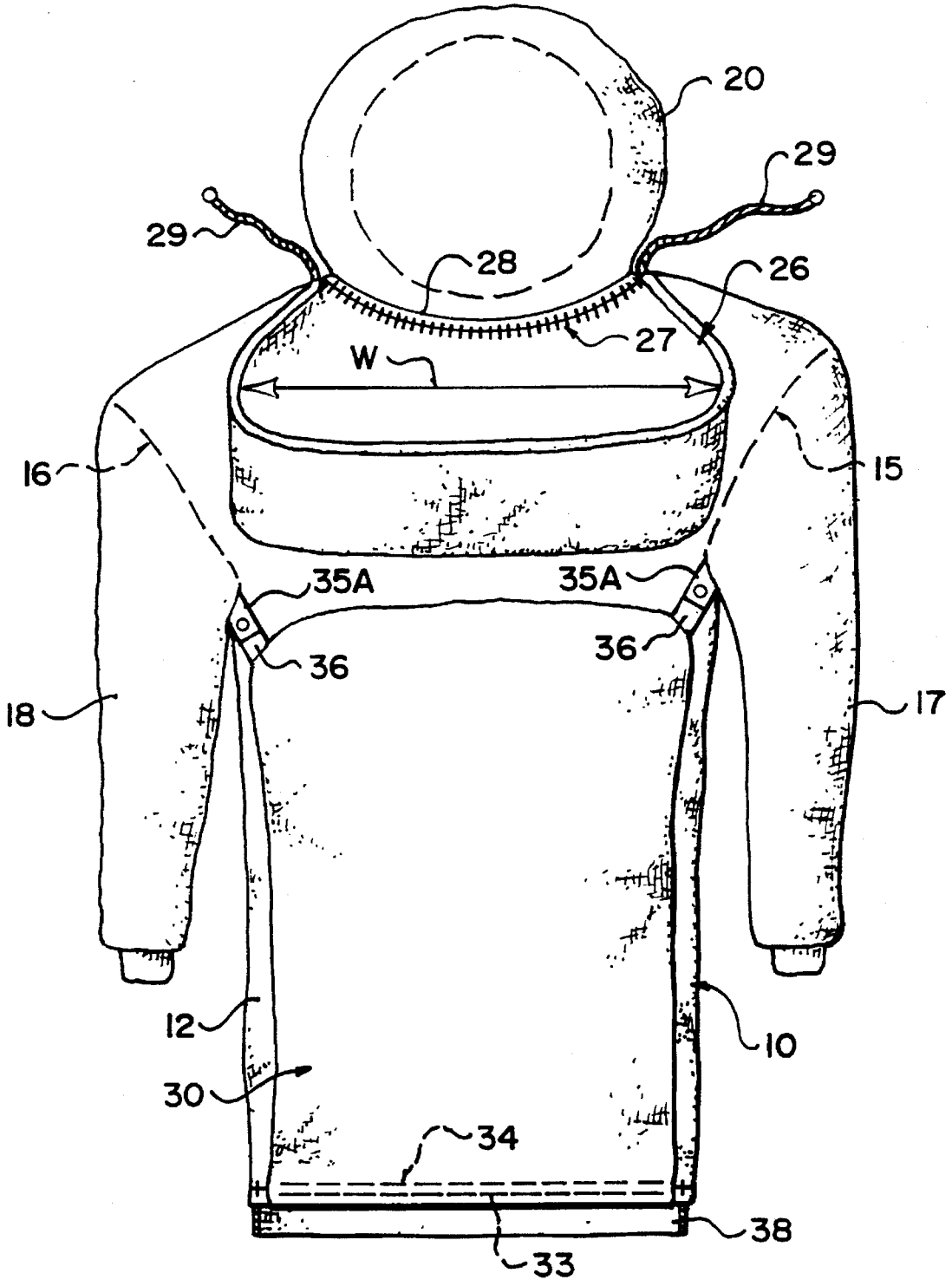
FIG. 2 is a rear elevational view of the winter survival suit of FIG. 1 with the leg bag folded up behind the wearer.

In FIG. 2 is shown an alternative location for the leg bag in which the leg bag is folded upwardly and outwardly of the suit body for attachment of the buckle parts 36 to similar buckle parts 35A again attached to the arm seams 19 but on the outside surface of the suit body.

In both storage positions of the leg bag, the leg bag assists in insulating the area of the wearer in the back, buttocks and back of the legs area which is particularly susceptible to cooling.

The survival suit therefore is usable as a conventional parka style winter coat but can convert using the second hood and the leg bag into a survival suit which covers the whole of the body of the wearer. The use of the leg bag by itself is desirable when the wearer is seated for example in ice fishing or stationary hunting. The leg bag and the outer hood can convert the suit into a "mummy" bag in a situation where the wearer is required to remain stationary but maintained warm by a full enclosure.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A winter survival suit for a wearer comprising:

a suit body having an upper collar opening for surrounding the neck of the wearer with the suit body extending downwardly from the collar opening to a generally horizontal open bottom edge of the suit body for surrounding the legs of the wearer;

two arm openings in the suit body each on a respective side of the suit body below the collar opening;

a pair of suit arms sewn into the arm openings at seams each surrounding a respective one of the arm openings;

a first hood attached to the collar opening so as to be engageable over the head of the wearer;

the suit body, suit arms and first hood being lined with an insulating material;

a front opening extending from the collar opening to the bottom edge which is closable by a manually operable closure member;

a leg bag having an open upper end and which is permanently closed at a bottom end and at sides by at least one stitched seam so that the only opening is at the upper end for surrounding the feet and part of the legs of the wearer;

a zipper for attaching the leg bag to the bottom edge;

the zipper being arranged such that the leg bag is wholly removable from the bottom edge;

the zipper being arranged such that the upper end of the leg bag is closable with the bottom edge around the full periphery thereof for extending to a position depending from the bottom edge;

the zipper being arranged and also being operable so as to connect the bag to the bottom edge of the suit body only across a rear part thereof leaving sides and a front of the bottom edge of the suit body free from the bag for closing around a front of the wearer such that the leg bag can be moved to a stored position;

and hanger means for holding the leg bag up in the stored position within the suit body to be carried thereby in an area from the arm openings to the bottom edge and behind the wearer;

the hanger means comprising a pair of first buckles each having a strap portion thereof stitched into the seam at a respective one of the arm openings and a pair of second buckles for cooperation with the first buckles each second buckle having a strap portion thereof stitched into a bottom seam closing the leg bag at a respective side thereof;

a length of the suit body from the arm openings to the bottom edge and a length of the leg bag being arranged such that the leg bag can be received in the stored position in the area wholly below the arm openings and such that the part of the legs and feet of the wearer can be received wholly within the closed bottom of the leg bag when in the depending position.

2. The winter survival suit according to claim 1 wherein the suit body has a pair of cooperating third buckles at the arm openings on an outside surface of the suit body for cooperating with the first buckles for alternately carrying the leg bag outside the suit body.

3. A winter survival suit for a wearer comprising:

a suit body having an upper collar opening for surrounding the neck of the wearer with the suit body extending downwardly from the collar opening to a generally horizontal open bottom edge of the suit body for surrounding the legs of the wearer;

two arm openings in the suit body each on a respective side of the suit body below the collar opening;

a pair of suit arms sewn into the arm openings at seams each surrounding a respective one of the arm openings;

a first hood permanently attached to the collar opening substantially contiguous therewith and so as to be engageable over the head of the wearer;

the suit body, suit arms and first hood being lined with an insulating material;

a front opening extending from the collar opening to the bottom edge which is closable by a manually operable closure member;

a leg bag having an open upper end and which is permanently closed at a bottom end and at sides by at least one stitched seam so that the only opening is at the under end for surrounding the feet and part of the legs of the wearer;

a zipper for attaching the leg bag to the bottom edge;

the zipper being arranged such that the leg bag is wholly removable from the bottom edge;

the zipper being arranged such that the upper end of the leg bag is closable with the bottom edge around the full periphery thereof for extending to a position depending from the bottom edge;

the zipper being arranged and also being operable so as to connect the bag to the bottom edge of the suit body only across a rear part thereof leaving sides and a front of the bottom edge of the suit body free from the bag for closing around a front of the wearer such that the leg bag can be moved to a stored position;

hanger means for holding the leg bag up in the stored position within the suit body to be carried thereby in an area from the arm openings to the bottom edge and behind the wearer;

the hanger means comprising a pair of first buckles each having a strap portion thereof stitched into the seam at a respective one of the arm openings and a pair of second buckles for cooperation with the first buckles each second buckle having a strap portion thereof stitched into a bottom seam closing the leg bag at a respective side thereof;

a length of the suit body from the arm openings to the bottom edge and a length of the leg bag being arranged such that the leg bag can be received in the stored position in the area wholly below the arm openings and such that part of the legs and feet of the wearer can be received wholly within the closed bottom of the leg bag when in the depending position;

the first hood including closure means for closing a front face of the hood around the face of the wearer to provide a front snorkel opening smaller than the face of the wearer;

a second hood formed from a fabric shell only attached to the suit body behind the first hood;

the second hood being wider between sides thereof than the first hood and longer from a rear edge to a front edge thereof than the first hood;

and closure means on the second hood for pulling the second hood closed over the head of the wearer and in front of the snorkel opening to fully enclose the first hood.

4. A winter survival suit for a wearer comprising:

a suit body having an upper collar opening for surrounding the neck of the wearer and extending downwardly from the collar opening to a generally horizontal open bottom edge for surrounding the legs of the wearer;

two arm openings in the suit body each on a respective side of the suit body below the collar opening;

a pair of suit arms sewn into the arm openings at seams each surrounding a respective one of the arm openings;

a first hood permanently attached to the collar opening substantially contiguous therewith and so as to be engageable over the head of the wearer;

the suit body, suit arms and first hood being lined with an insulating material;

a front opening extending from the collar opening to the bottom edge which is closable by a manually operable closure member;

a leg bag having an open upper end for surrounding the feet and part of the legs of the wearer;

a zipper for attaching the leg bag to the bottom edge;

hanger means for holding the leg bag up in the stored position within the suit body to be carried thereby in an area from the arm openings to the bottom edge and behind the wearer;

the first hood including closure means for closing a front face of the hood around the face of the wearer to provide a front snorkel opening smaller than the face of the wearer;

a second hood formed from a fabric shell only attached to the suit body behind the first hood;

the second hood being wider between sides thereof than the first hood and longer from a rear edge to a front edge thereof than the first hood;

and closure means on the second hood for pulling the second hood closed over the head of the wearer and in front of the snorkel opening to fully enclose the first hood and to fully cover the snorkel opening.

* * * * *